US007384031B2

(12) United States Patent
Noll, Jr. et al.

(10) Patent No.: US 7,384,031 B2
(45) Date of Patent: Jun. 10, 2008

(54) PRODUCT SEPARATOR AND FEEDER

(75) Inventors: Harry C. Noll, Jr., Whitehall, PA (US); Timothy E. Goszka, Emmaus, PA (US); Randy R. Seidel, Allentown, PA (US)

(73) Assignee: Graphic Management Associates, Inc., Allentown, PA (US)

( * ) Notice: Subject to any disclaimer, the term of this patent is extended or adjusted under 35 U.S.C. 154(b) by 384 days.

(21) Appl. No.: 11/092,314

(22) Filed: Mar. 29, 2005

(65) Prior Publication Data

US 2005/0218580 A1 Oct. 6, 2005

Related U.S. Application Data

(60) Provisional application No. 60/557,716, filed on Mar. 30, 2004.

(51) Int. Cl.
*B65H 5/08* (2006.01)
*B65H 3/08* (2006.01)

(52) U.S. Cl. ..... 271/101; 271/99; 271/100; 271/106

(58) Field of Classification Search ..... 271/99, 271/100, 101, 102, 106, 107
See application file for complete search history.

(56) References Cited

U.S. PATENT DOCUMENTS 2,552,869 A 5/1951 Sauerman
2,564,417 A 8/1951 Baker
2,918,279 A 12/1959 Jackson
3,371,331 A 2/1968 Buckholz
3,394,930 A 7/1968 Guggisberg
3,586,316 A 6/1971 Ehlscheid
4,470,589 A 9/1984 Singer
4,509,736 A 4/1985 Stahl et al.
4,723,770 A 2/1988 Seidel et al.
5,029,834 A 7/1991 Boldrini et al.
5,586,756 A * 12/1996 Chang ..... 271/11
5,967,508 A 10/1999 Olexy
6,015,145 A 1/2000 Hartel
6,017,030 A 1/2000 Seidel et al.
6,082,724 A 7/2000 Kahlig et al.

FOREIGN PATENT DOCUMENTS

JP 50-44591 5/1975
JP 7206189 8/1995

* cited by examiner

*Primary Examiner*—Kaitlin Joerger
(74) *Attorney, Agent, or Firm*—Lucas & Mercanti, LLP

(57) ABSTRACT

This invention discloses an apparatus and method for separating and feeding flat products from a stack to a gripper drum. The invention employs a specially-positioned pivoting and articulating sucker bar, having several degrees of motion, operating in timed relationship with a reciprocating and articulating pusher blade, to reduce the travel distance of vacuum suckers, to reduce the diameter of the gripper drum, and to increase the speed at which products are separated from the stack and transferred to the gripper drum.

8 Claims, 7 Drawing Sheets

SECTION A-A

SECTION B-B

PRODUCT SEPARATOR AND FEEDER

CROSS REFERENCE TO RELATED APPLICATION

Reference is made to prior copending U.S. provisional patent application No. 60/557,716, filed Mar. 30, 2004, entitled "Product Separator and Feeder," by the inventors of the present invention. Such application is incorporated herein by reference.

NO GOVERNMENT RIGHTS

No federally-sponsored research or development was involved with this application.

BACKGROUND OF THE INVENTION

1. Field of the Invention

This invention relates to an improved apparatus and method for separating flat products such as newspapers and inserts from a stack and feeding them to a drum or other moving machine parts at high speed.

2. Art Relating to the Invention

At present, machines for handling flat products, such as newspaper insert machines, often include one or more automatic feeders for feeding the products from a stationary stack to other moving parts of the machine. One item at a time is separated from the stack, either from the top or the bottom, and transferred to a rotating drum or other moving part by a separator device housed within a product feeder. Typically, one or more product feeders are mounted above a conveyor carrying open moving pockets, and the feeders transfer products from the drum into the pockets. An example of an insert machine is shown in U.S. Pat. No. 4,723,770.

If the flat products are thin or flexible, such as paper sheets or jackets, then several engineering challenges present themselves for proper and efficient machine operation. First, one item at a time must be separated from the stack without separating or damaging the remaining items. Since sheets of paper, for example, tend to stick together when stacked due to friction and air pressure, a means of separating one sheet from the stack sometimes includes a suction device to pull one sheet away while leaving the remaining sheets in place. After separation, the item must be transferred from the stationary stack to other parts of the machine that are moving, such as a rotating drum or a conveyor.

One example of a prior art separator and feeder apparatus is shown in FIG. 1. A hopper having a table 2 holds a stack of flat products 1. A reciprocating sucker bar 6 is pivotally mounted beneath the lowermost product in the stack. One or more suckers 5 are attached to one end of the sucker bar, and the bar pivots around its other end. Note that, in this prior art device, the pivot point of the sucker bar is situated directly underneath the table and the stack.

Beneath the hopper and the sucker bar, there is mounted a rotating drum 3, which carries one or more grippers 7 around its periphery. The grippers open and close at certain, timed positions as the drum rotates (counterclockwise in FIG. 1).

In operation, as an open gripper rotates up towards the hopper, sucker bar 6 pivots upward and suction is applied to the sucker 5. The sucker approaches and then makes contact with an edge portion of the lowermost product in the hopper. As used herein, this edge portion, which is the portion closest to the drum, is called the leading edge of the product.

Next, the sucker bar 6 pivots downward, causing sucker 5 to peel the leading edge of the lowermost product away from the leading edge of the next lowermost product in the stack by suction, and to bend the leading edge of the lowermost product downward. This creates a gap between the lowermost product and the next lowermost product. Meanwhile, the gripper 7 continues to rotate toward the stack. When the gripper moves into a position immediately below the bent-down leading edge of the lowermost product, the gripper closes and grabs the leading edge. Suction is then immediately released from the sucker 5, and the gripper then pulls the product down and around a portion of the periphery of the drum 3. Subsequently, the gripper opens and releases the product into a moving pocket 4, which carries the product away for further processing.

While the above-mentioned prior art separator and feeder apparatus accomplishes the task of separating one product from a stack of products and transferring it to a rotating drum, it has certain limitations that limit the speed of operation of the machine. For example, since the sucker bar is positioned underneath the stack in the prior art, in order for the sucker to clear the leading edge of the paper in time, the sucker bar must swing down (counterclockwise in FIG. 1).

In addition, in order for the sucker bar 6 to position the leading edge of the product accurately for proper pick-up by the gripper 7, the sucker bar must pivot all the way down, such that the "final," extended position of sucker 5 is almost touching the rotating drum. In other words, the distance that the sucker must "travel" is the entire distance between the bottom side of the lowermost product in the stack and the uppermost periphery of the drum. Since there are mechanical limits on how quickly the sucker bar can be pivoted back and forth, the necessity for the sucker to make a "full travel" limits the speed at which products can be separated from the stack and transferred to the drum. This full travel requirement also increases the amount of time that suction must be applied to the sucker, and also increases wear and tear on the sucker bar. In addition, this arrangement requires the drum to have a relatively large diameter, placing limits on the rotational speed of the drum. Consequently, the above disadvantages place an upper limit on the speed of the entire machine. It is desirable to overcome these limitations, particularly in machines such as newspaper insert machines, where extremely high speeds are required.

SUMMARY OF THE INVENTION

To overcome the limitations of the prior art, an improved product separator and feeder apparatus and method has now been developed which is capable of separating flat products from a stationary stack of flat products, and transferring and feeding each product individually to a drum or other moving parts of a machine, efficiently and at extremely high speeds.

In order to accomplish this, the separator and feeder apparatus of the present invention employs a unique, specially-positioned pivoting and articulating sucker bar, having several degrees of motion, operating in timed relationship with a unique reciprocating and articulating pusher blade, to reduce the travel distance of vacuum suckers and to increase the speed at which products are separated from a stack and transferred to a rotating drum, for subsequent transfer to a moving pocket.

More specifically, one embodiment of the invention comprises an apparatus for separating and feeding flat products from a stack of flat products, comprising:

a pivoting and articulating sucker bar having at least one sucker mounted thereon, the sucker bar arranged to pivot around a cam profile mounted to one side of and above a lowermost product in the stack, the sucker arranged to periodically pivot up, articulate toward and make contact with a leading edge of such lowermost product and then to pivot down, articulate away and pull down and away such edge by suction to create a gap between such lowermost product and a next lowermost product in the stack; and a reciprocating and articulating pusher blade arranged to push into such gap, and articulate down, in timed relationship with the sucker bar, to further separate such lowermost product from such next lowermost product, and to push down such leading edge to bring such edge to within range of a gripper.

Another embodiment of the invention comprises a method for separating and feeding a flat product from a stack of flat products, comprising the steps of:

pivoting a sucker about a cam profile located to a side of a stack of flat products, and articulating the sucker toward the stack, until the sucker makes contact with the bottom of a lowermost product in the stack;

applying vacuum to the sucker;

pivoting the sucker down, and articulating the sucker away, from the stack, to create a gap between the lowermost product and a next lowermost product in the stack, and to begin to pull down and away a leading edge of the lowermost product;

pushing a blade into the gap to engage the top of a leading edge of the lowermost product;

releasing the vacuum from the sucker; and articulating the blade downwards so as to push the leading edge of the lowermost product down and away from the stack and to within range of a gripper.

BRIEF DESCRIPTION OF THE DRAWINGS

These and other aspects of the present invention may be more fully understood by reference to one or more of the following drawings, in which.

DETAILED DESCRIPTION OF THE INVENTION

The following description disclosed an embodiment of the present invention that is particularly useful for separating flat paper products, such as newspapers, newspaper inserts and jackets, from the bottom of a stationary stack of flat products, and transferring them at high speeds to a rotating drum of a product feeder, for subsequent delivery to open moving pockets on a linear conveyor of a newspaper insert machine. The invention is not, however, limited to such use and is usable in any environment where separation and transfer of individual flat items from a stack of flat items to another moving machine part is necessary or desirable.

Figure 1:
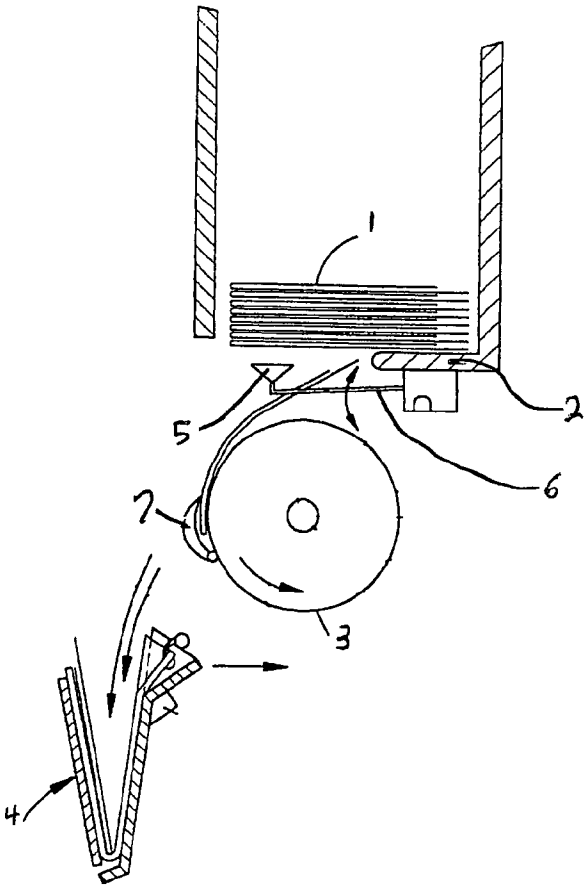
FIG. 1 (PRIOR ART)
FIG. 1 is a side view of a prior art separator and feeder apparatus.
Figure 2:
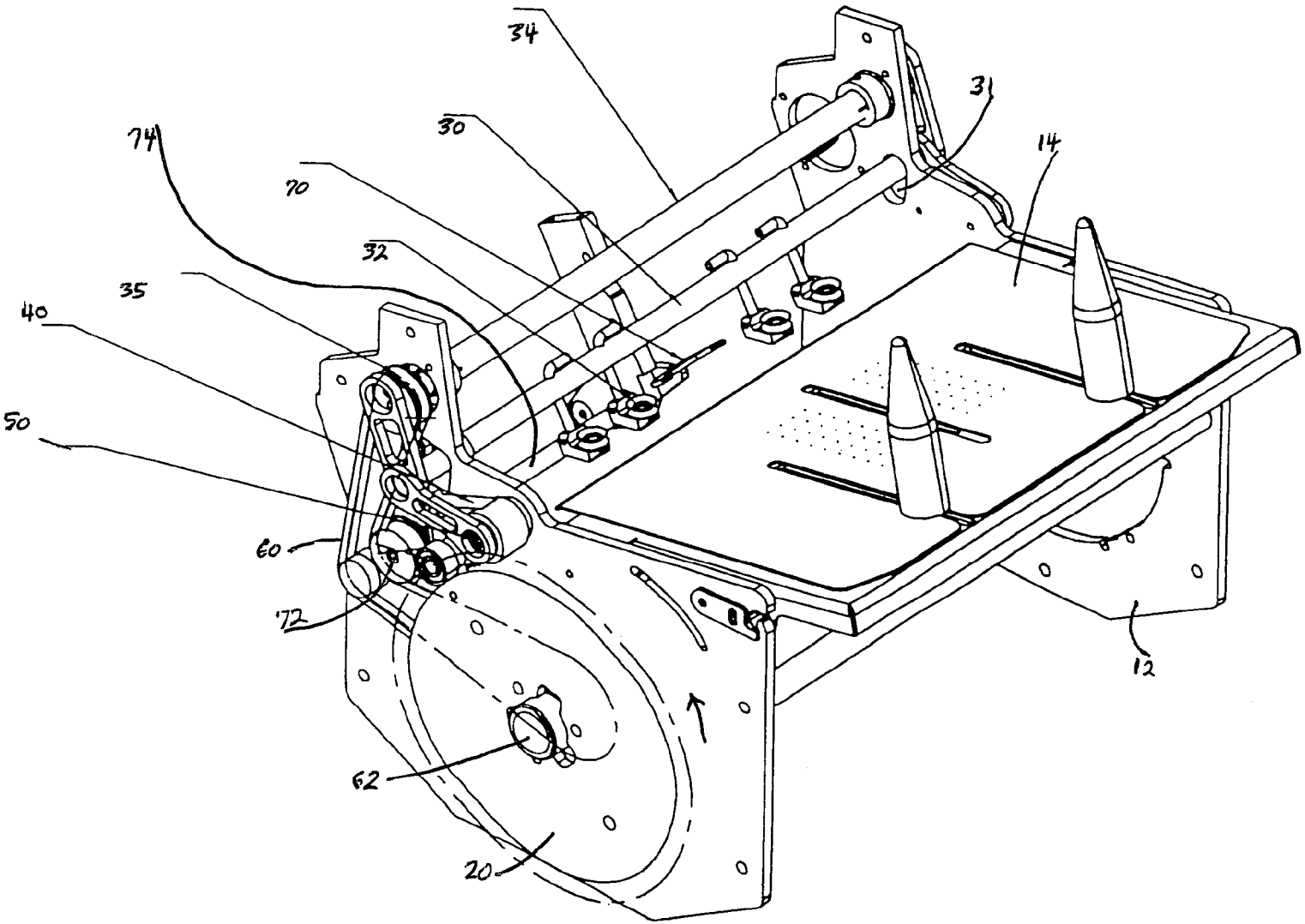
FIG. 2 is a perspective view of the product separator and feeder of the present invention.
Figure 5:
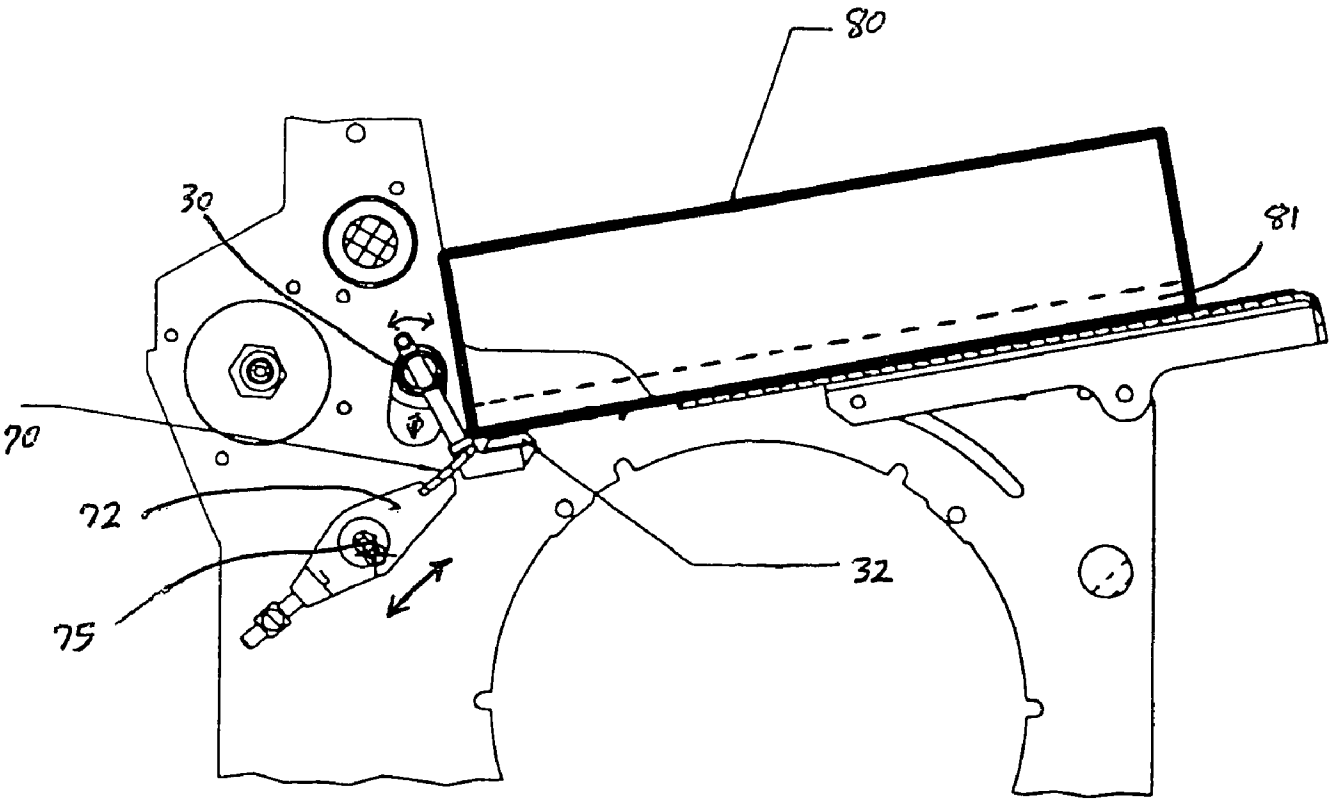
FIG. 5 is a side partial sectional view of the invention, taken along lines B-B of FIG. 3.

Turning now to the drawings, FIG. 2 is a perspective view of the product separator and feeder of the present invention. The separator and feeder includes an approximately box-shaped frame 12 of metal or other suitable rigid material, on which is mounted a table 14 suitable for holding a stack of flat items such as paper sheets 80 (FIG. 5). An optional jogger plate 100 (FIG. 6) may also be included adjacent to the table.

Figure 6:
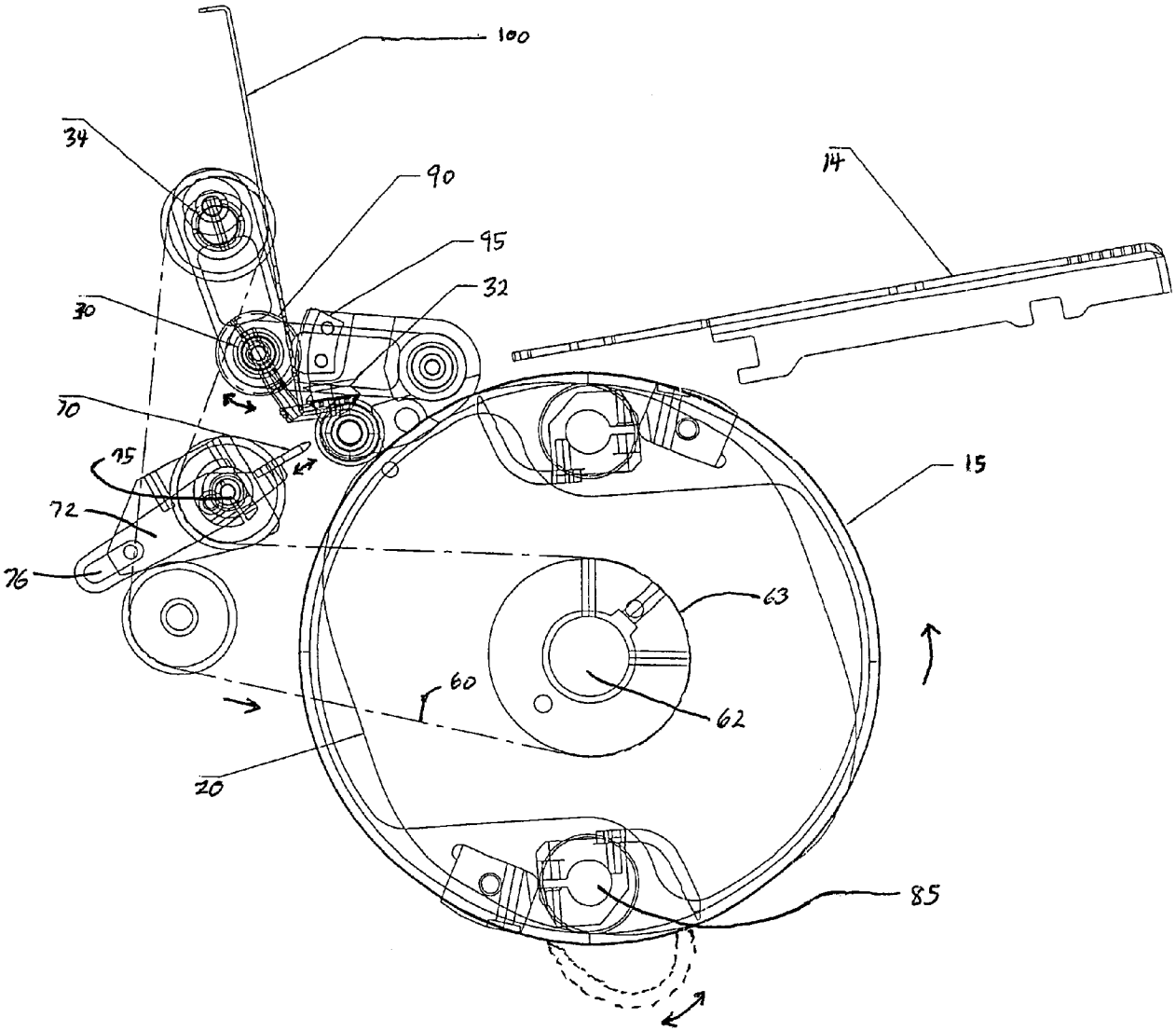
FIG. 6 is a side sectional view of the invention, showing the invention mounted adjacent to a rotating drum of a product feeder.

Rotatably mounted under the table 14 and preferably within the frame 12 is a drum 15 (FIG. 6) mounted on a drum drive shaft 62, which is driven by an electric motor (not shown). Preferably mounted around the periphery of the drum are a plurality of grippers 85 (FIG. 6).

Referring to FIG. 2, in a feature of the invention, mounted within the frame and preferably oriented parallel to the drum drive shaft 62 is a pivoting and articulating sucker bar 30 and an associated sucker bar drive shaft 34, also oriented parallel to the drum drive shaft. Attached to the sucker bar is at least one sucker 32. Preferably, multiple suckers are employed. The sucker bar is arranged to pivot around a pivot point or profile 50, and also to articulate up and down. (See also FIG. 4.)

Sucker bar 30 is rigid and hollow and is suitable for supplying vacuum and air to the suckers. A flexible hose (not shown) is attached between the sucker bar and a vacuum and air manifold (not shown). Preferably, the suckers are rubber, cup-shaped and suitable for forming a seal between the sucker and a sheet of newspaper or other flat item when vacuum is applied to the sucker and the sucker is brought into contact with the item, preferably from below. The purpose of the suckers is to grab and pull down and away a leading edge of the lowermost sheet in the stack during a separating and feeding operation.

In another feature of the invention, and unlike product separators and feeders in the prior art, the pivot points or areas of sucker bar 30 are not located under the table 14 holding the stack of flat products 80. Instead, the sucker bar is pivotally and articulably mounted within the frame sideways away from the table and the stack. More particularly, in FIGS. 2 and 5, it can be seen that sucker bar 30 is mounted to the left of, and not under, table 14, and approximately horizontal in relation to leading edges (toward the left in this view) of products in the stack (see FIG. 5).

Figure 4:
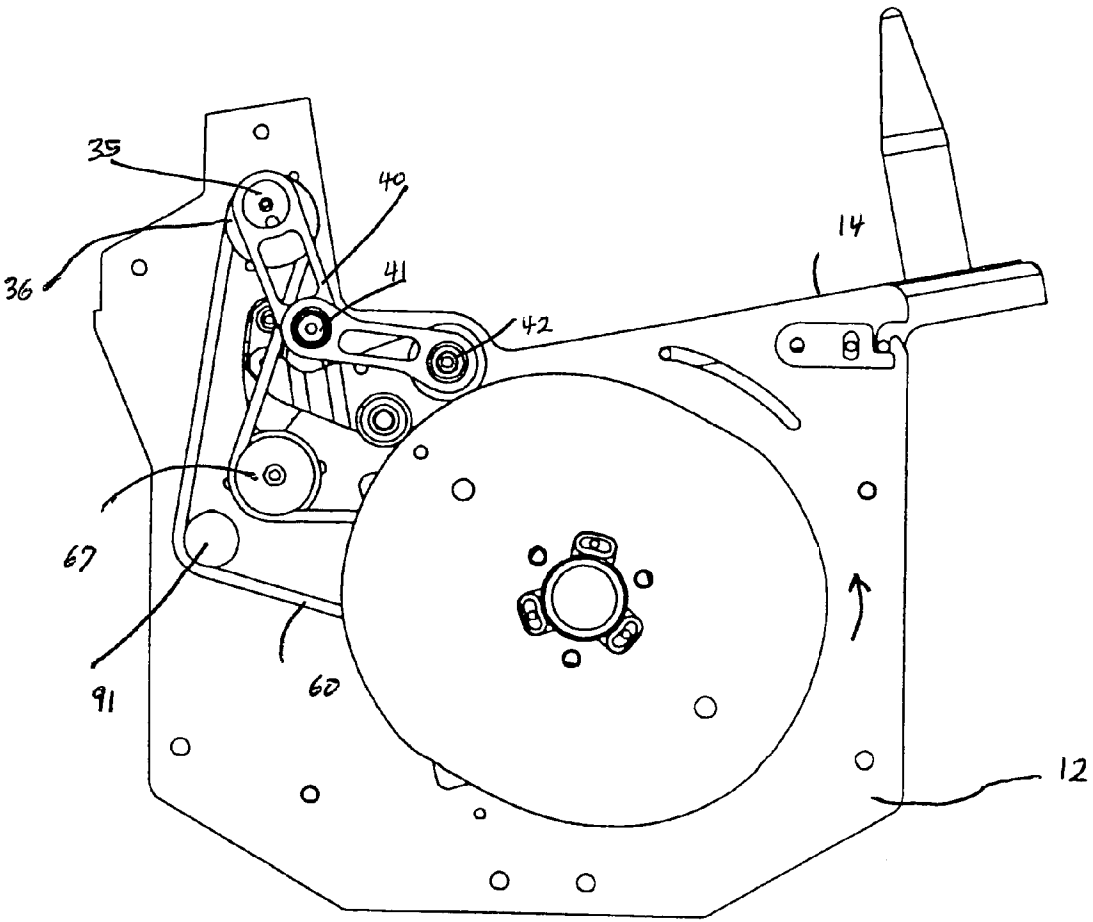
FIG. 4 is a side partial sectional view of the invention, taken along lines A-A of FIG. 3.

In yet another feature of the invention, and as best seen in FIGS. 2 and 5, the sucker bar has more than one degree of motion. Not only does the sucker bar pivot about an axis parallel to the axis of rotation of the drum, but the sucker bar also articulates up and down, perpendicular to the pivoting axis, within elongated slots 31 in the frame (FIG. 2.). This arrangement further reduces the travel distance required for the attached sucker(s) to pivot and articulate toward and away from the lowermost product 81 (FIG. 5) in the stack, permits the sucker vacuum to be released earlier, and permits the drum diameter to be decreased, thus further increasing the speed of product separation and As best seen in FIG. 4, mounted to both ends of sucker bar drive shaft 34 are sucker bar cranks 35 and associated pulleys 36. Each crank 35, in turn, is pivotally attached to one end of a hinged, articulating sucker bar control lever 40. Hinge point 41 in the approximate middle of each control lever 40 is fixedly mounted to one end of the sucker bar drive shaft, and other end of the control lever 40 is pivotally mounted to the frame 12 at pivot points 50. Crank 35, lever 40, hinge point 41, and pivot point 42 together define a cam profile about which sucker bar 30 travels when it is in motion.

Figure 3:
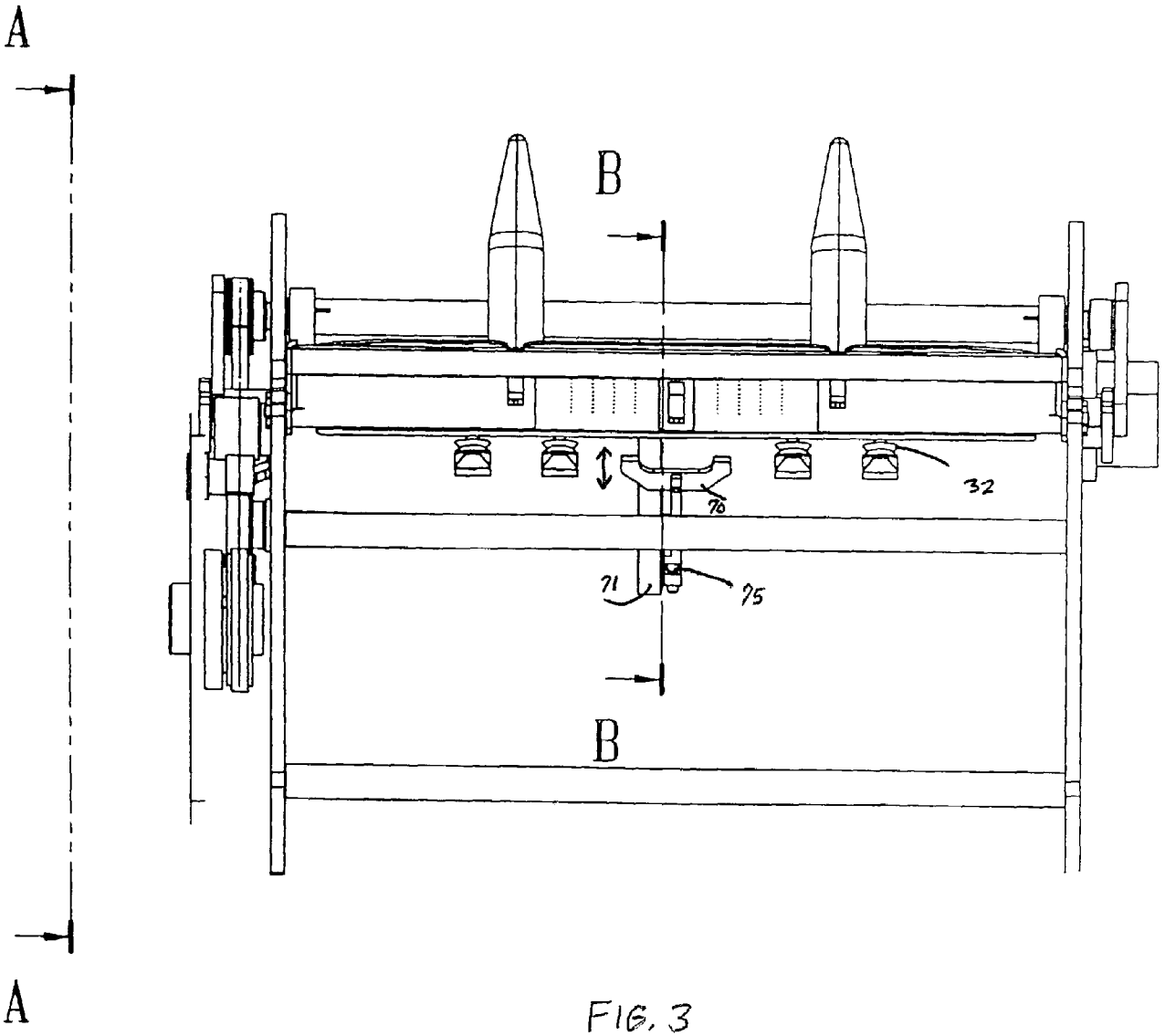
FIG. 3 is a top view of the invention.

In another feature of the invention, mounted to frame 12, and as best seen in FIGS. 3, 5 and 6, is a pusher blade mount 71, on which a pusher blade 70 is mounted so as to reciprocate and articulate when in motion. A major purpose of pusher blade 70 is to push into a gap between the lowermost sheet 81 in the stack and the second lowermost sheet after the suckers 32 have pulled down and away the leading edge of the lowermost sheet, and then to push the leading edge down further toward rotating drum 15 (FIG. 6) until the leading edge is within range of an open gripper 85 mounted on the periphery of the drum. As can be seen in FIG. 6, grippers 85 pivot back and forth as the drum rotates. The solid line shows the grippers in their fully retracted position, and the dashed line shows the grippers in their fully extended position.

Pusher blade 70 is positioned close to sucker bar 30 (FIGS. 2 and 5) and preferably approximately midway between opposite sides of the frame, and in between the suckers, so as to avoid interference with the suckers during operation, and so as to provide for an even push-down of the product toward the drum.

As shown in FIGS. 5 and 6, pivotally attached to pusher blade 70 is a crank 75 that is also attached to pusher blade drive shaft 34.

In the preferred embodiment, and as best seen in FIG. 4, sucker bar drive shaft 34 and pusher blade drive shaft 74 are rotatably driven in synchronization with the drum 15 by means of a belt or chain 60 that loops around a pulley or gear 63 (FIG. 6) mounted on the drum drive shaft 62, then around an idler wheel 91, around a sucker bar drive shaft pulley or gear 36, then around a pusher bar drive shaft pulley or gear 67, and back around the drum drive shaft pulley 63.

In operation, as the drum rotates (counterclockwise in FIGS. 5 and 6), a vacuum is periodically created in a manifold (not shown) through a vacuum inlet (not shown). Sucker bar 30 then pivots (counterclockwise in FIGS. 5 and 6), and also articulates up and down within slot 31. As the suckers 32 approach the leading edge of the lowermost sheet 81, a vacuum is applied to the suckers 32 through the sucker bar. The leading edge of the lowermost sheet is engaged by the suckers. The suckers then pivot down and away, thus pulling the leading edge of the lowermost sheet down and away from the stack, and creating a gap between the lowermost sheet and the next lowermost sheet. After a brief interval, air is then blown into the manifold through an air inlet to release the vacuum in the suckers. This permits the suckers 32 to alternatively grab and release the leading edge of flat items such as a paper inserts from a stationary table 14 or hopper area, for transfer to the pusher blade and later to the rotating drum. After release of the vacuum, the pusher blade is pushed into the gap between the lowermost and next lowermost sheets, and then articulated down to push the lowermost sheet further away from the next lowermost sheet, and within range of the grippers 85 on the rotating drum. As the grippers move within range, the grippers grab the leading edge of the lowermost sheet, and pull the sheet down and partially around the periphery of the drum. A short time later, the grippers are released, and the sheet is released into a moving pocket on a conveyor.

Figure 7:
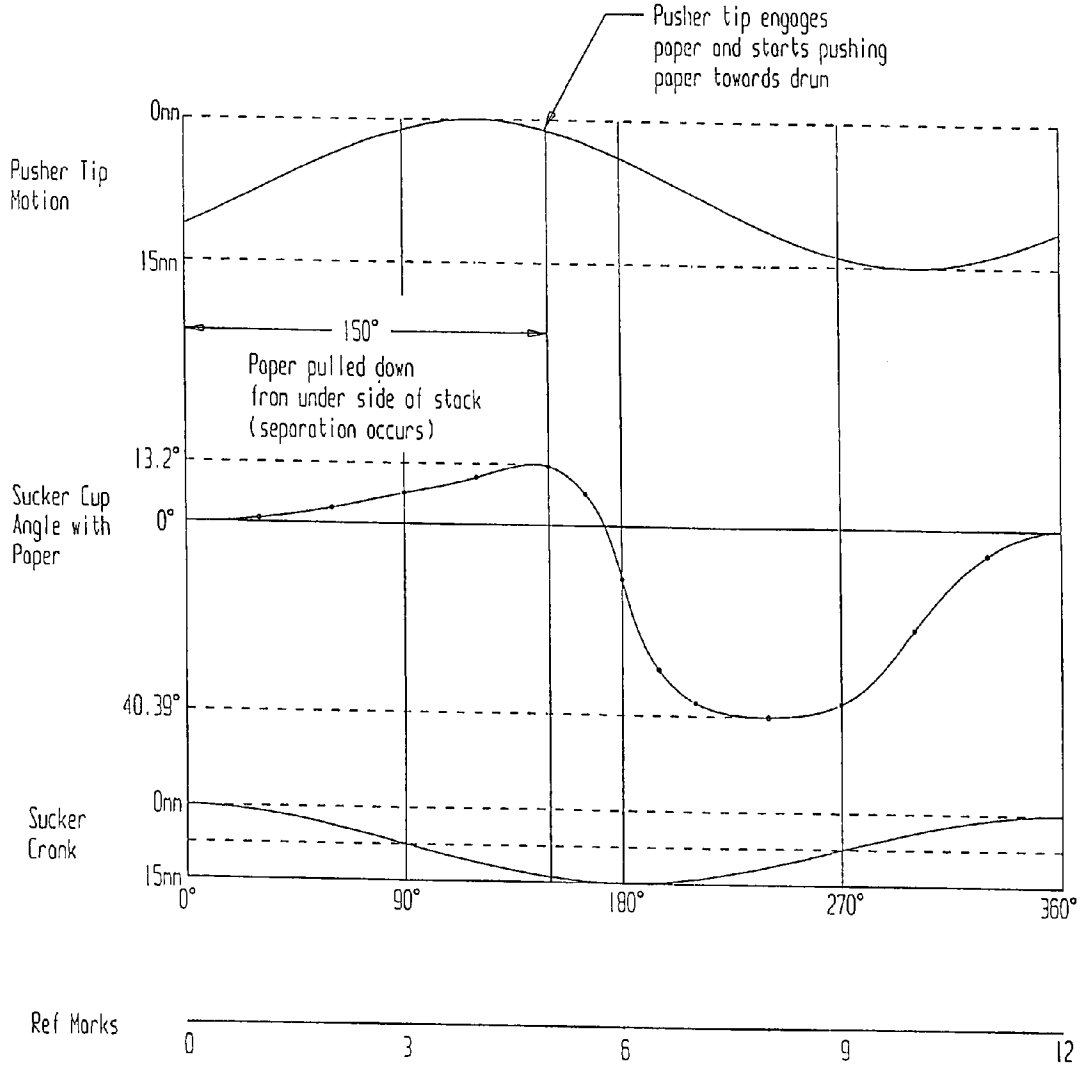
FIG. 7 is a timing diagram showing time relationships of motions of the pusher tip, sucker cup and sucker crank of the invention.

FIG. 7 is a timing diagram showing preferred time relationships of motions of the pusher tip, sucker and sucker crank of the invention. The horizontal axis shows degrees of rotation of the drum. At position 0 degrees, the sucker starts to pivot upward and articulate toward the lowermost sheet in the stack of paper. After approximately 150 degrees of rotation, the sucker has engaged the leading edge of the lowermost sheet, has separated it from the underside of the stack, and is starting to pivot and articulate down and away from the stack. At this point, the tip of the pusher blade engages the lowermost sheet and starts pushing the sheet toward the drum. Vacuum is also released from the sucker at this point, or slightly before this point, and the sucker pivots rapidly downward.

Between positions of approximately 180 degrees and 270 degrees, while the pusher blade is still pushing the lowermost sheet toward the drum, the sucker begins to reverse direction and move toward the stack in preparation for engaging the next lowermost sheet in the stack. This is a significant feature of the invention in that this arrangement and method of operation permits two sheets to be handled at the same time. Specifically, before the pusher blade has finished pushing the lowermost sheet down to within range of the grippers, the suckers are already moving toward the next lowermost sheet, or have already engaged the next lowermost sheet.

In summary, the present invention provides several advantages over the prior art. First, the sucker bar and pusher blade work in coordinated fashion in multiple ways to separate each product from a stack of products. This reduces the stroke distance of the sucker. The short stroke of the cups allows for decreased response time and increased speed. The sucker movement, pusher blade movement, and vacuum and air operations are all carefully timed and coordinated with the movement and operation of the drum and the grippers to facilitate the quick separation and feeding of flat material.

Using the present invention, it has been discovered that the sucker need travel only about ⅓ of the distance between the stack and the drum. Also, the vacuum can be released from the sucker sooner, and thus disengage the sucker from the paper sooner so that the sucker can move out of the way and prepare to engage the next sheet in the stack. And since the pusher blade is to the side of, and hence out of the way of, the suckers, the suckers can start to pivot up toward the next sheet in the stack while the pusher blade is still pushing the first sheet down toward the drum. Consequently, the coordination of the parts of the present invention permits the parts to work together to provide multiple ways to increase the speed of product separation and feeding, and hence to increase the overall speed of the entire machine.

Although only one embodiment of the present invention has been expressly disclosed, it is, nonetheless, to be broadly construed, and not to be limited except by the character of the claims appended hereto.

What is claimed is:

1. An apparatus for separating and feeding flat products from a stack of flat products, comprising:

a pivoting and articulating sucker bar having at least one sucker mounted thereon, the sucker bar arranged to pivot around a cam profile mounted to one side of and above a lowermost product in the stack, the sucker bar further arranged to periodically pivot up, articulate nonlinearly toward and make contact with a leading edge of such lowermost product and then to pivot down, articulate away and pull down and away such edge by suction to create a gap between such lowermost product and a next lowermost product in the stack; and a reciprocating and articulating pusher blade arranged to push nonlinearly into such gap, and nonlinearly articulate down, in timed relationship with the sucker bar, to further separate such lowermost product from such next lowermost product, and to push down such leading edge to bring such edge to within range of a gripper.

2. The apparatus of claim 1, in which the gripper is mounted at the periphery of a rotatable drum.

3. The apparatus of claim 1, in which the sucker bar and pusher blade are timed to operate on two products simultaneously, in that the sucker bar begins to pull down and away the leading edge of the next lowermost product in the stack before the pusher blade has finished pushing down the leading edge of the lowermost product in the stack.

4. The apparatus of claim 2, in which the sucker bar and sucker are mounted external to the drum.

5. A method for separating and feeding a flat product from a stack of flat products, comprising the steps of:

pivoting a sucker about a cam profile located to a side of a stack of flat products, and articulating the sucker toward the stack, until the sucker makes contact with the bottom of a lowermost product in the stack;

applying vacuum to the sucker;

pivoting the sucker down, and articulating the sucker away, from the stack, to create a gap between the lowermost product and a next lowermost product in the stack, and to begin to pull down and away a leading edge of the lowermost product;

pushing a blade into the gap to engage the top of a leading edge of the lowermost product;

releasing the vacuum from the sucker; and articulating the blade downwards so as to push the leading edge of the lowermost product down and away from the stack and to within range of a gripper.

6. The method of claim 5, in which the gripper is mounted at the periphery of a rotatable drum.

7. The method of claim 5, in which the sucker and blade are timed to operate on two products simultaneously, in that the step of pivoting and articulating the sucker down and away so as to pull down and away the leading edge of the next lowermost product in the stack begins before the step of pushing and articulating the blade down so as to push down the leading edge of the lowermost product in the stack.

8. The method of claim 6, in which the sucker bar and sucker are mounted external to the drum.

* * * * *